United States Patent [19]

Evans

[11] 4,343,466

[45] Aug. 10, 1982

[54] FRICTIONAL RESISTANCE TYPE EXERCISER AND METHOD OF FORMING AN EXERCISING DEVICE

[76] Inventor: Roger C. Evans, 10214 Dogwood Ave., Palm Beach Gardens, Fla. 33410

[21] Appl. No.: 94,531

[22] Filed: Nov. 15, 1979

[51] Int. Cl.[3] ..... A63B 21/00

[52] U.S. Cl. ..... 272/133; 140/71 R

[58] Field of Search ..... 272/133, 131, DIG. 3, 272/75; 188/65.1, 65.4, 65.2; 242/156; 182/103, 6, 5, 190, 133; D21/191, 235

[56] References Cited

U.S. PATENT DOCUMENTS

| | | | |
|---|---|---|---|
| 147,828 | 2/1874 | De Boucherville | 272/133 X |
| 3,217,840 | 11/1965 | Holkesvick | 272/133 X |
| 3,472,510 | 10/1969 | Holkesvick | 272/133 |
| 3,510,132 | 5/1970 | Holkesvick | 272/133 X |
| 3,650,531 | 3/1972 | Pridham | 272/133 |
| 3,656,745 | 4/1972 | Holkesvick | 272/133 |

FOREIGN PATENT DOCUMENTS

| | | | |
|---|---|---|---|
| 75405 | 5/1894 | Fed. Rep. of Germany | 272/133 |
| 911713 | 5/1954 | Fed. Rep. of Germany | 272/75 |
| 559 | of 1902 | United Kingdom | 272/75 |

*Primary Examiner*—Richard C. Pinkham
*Assistant Examiner*—William R. Browne
*Attorney, Agent, or Firm*—Jack N. McCarthy

[57] ABSTRACT

An exercising device has a body made from one solid continuous piece of contoured rod using the variable friction resistance rope principle. The body is formed having two spaced rod sections, one end of each of the rod sections bends inwardly and extends towards a center line with the two rod sections then bending to extend substantially parallel to a point where they then bend towards each other and join to form a curved end; this arrangement forms a neck and shoulder portion. The two spaced rod sections taper towards each other where they form short parallel rod sections at the opposite end of the body with the ends of the rods joining to form a second curved end. Resistance is varied by passing the rope around the rod a selected number of turns. The number of loops around the rod directly affect the friction resistance developed. A rope guide is removably fixed to the short parallel rod sections at the opposite end of the body and guides the rope to aid in maintaining the rope at a desired location as it passes from the body.

4 Claims, 4 Drawing Figures

FRICTIONAL RESISTANCE TYPE EXERCISER AND METHOD OF FORMING AN EXERCISING DEVICE

BACKGROUND OF THE INVENTION

This invention relates to the art of physical conditioning and more specifically to the principle of isokinetic exercising. This is a combination of isotonic and isometric techniques. This exerciser allows the user to tire a muscle isometrically and then move the tired muscle group isotonically through a complete range of motion at a constant speed.

The principle of friction resistance devices dates back to the nineteenth century when friction resistance brakes were used for fire escapes. (See U.S. Pat. No. 434,888 to Ross and U.S. Pat. No. 779,550 to Leffelman.)

The principle was carried into the twentieth century when several devices were invented to use this principle in exercising. The principle, quite simply, is one of wrapping a rope around a shaft. As the surface area of the rope in contact with the shaft increases by adding more loops or turns, the friction to overcome the drag increases, and the user has to provide more work to overcome the increased load.

Patents involving this principle are set forth as follows: U.S. Pat. No. 3,197,204; U.S. Pat. No. 3,506,262; U.S. Pat. No. 3,510,132; U.S. Pat. No. 3,519,269; and U.S. Pat. No. 3,591,174.

SUMMARY OF THE INVENTION

One of the principal objectives of this invention is to provide a variable resistance rope exercising device in the simplest state of the art, made from only one solid continuous piece of contoured rod. This exerciser is able to provide maximum to minimum load conditions for a variety of users and their specific needs.

An additional objective is to provide an exerciser where the rope can be easily removed for alternate use, such as jumping rope, or so that optional ropes designed to aid athletes in certain sports can be easily threaded for use with the same exercising unit.

Another object of this invention is to provide a rope whereby the length of rope needed for each exercise could easily be obtained by merely tying a slip knot above the rope handle, thus not allowing the excess rope to slip back through the handle during exercise. This knot can be easily removed, thus allowing a smooth transition between exercises and cutting down the total time needed to exercise.

It is a further object of this invention to provide an exercising device having a body formed from one solid continuous piece of contoured rod having a neck and shoulder portion at one end with a rod section extending down from each shoulder and tapering inwardly to a short parallel section at the other end thereof, each end being formed with a curve. The two rod sections taper toward each other to reduce rotation of the body by keeping the ropes as close to the rotating axis of the body as possible. The shoulders are shown extending perpendicular to the axis of the body to prevent the rope from slipping easily thereunder.

Another object of the invention is to provide a rope guard to aid in maintaining the rope at a desired location as it passes from the body at the opposite end from the neck and shoulder.

DESCRIPTION OF THE PREFERRED EMBODIMENT

Figures 1, 2, 3, 4:
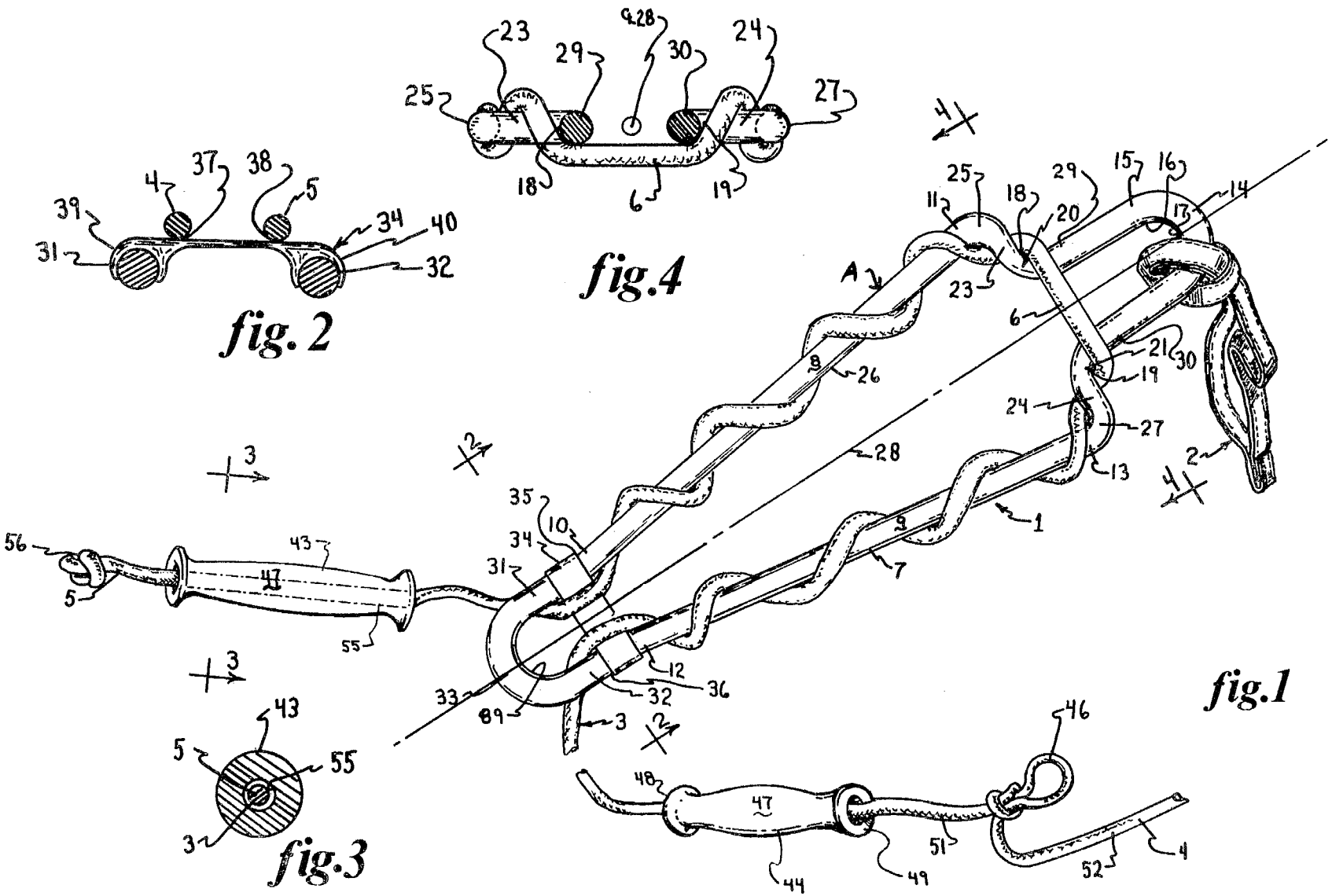
FIG. 1 is a front view of the body of the exercising device with a rope positioned thereon along with a support means.
FIG. 2 is an enlarged view taken along the line 2—2 of FIG. 1.
FIG. 3 is an enlarged view taken along the line 3—3 of FIG. 1.
FIG. 4 is a view taken along the line 4—4 of FIG. 1.

FIG. 1 of the drawings illustrates a variable friction-resistance rope exercising device generally designated by the number 1. The exercising device 1 includes a body A, formed as only a single continuous contoured rod that is supported by support means 2 shown in the form of a strap which may be hooked or attached by other known means to a rigid structure during use. Other types of support means well known in the art can be used. The exercising device 1 also includes a rope having an end section 4 and an end section 5 with a continuous intermediate section 6. Ends 4 and 5 of the rope 3 have handles 44 and 43 positioned thereon, respectively.

The body A is formed having two spaced rod sections 26 and 7 (see FIG. 1) that have exterior cylindrical surfaces 8 and 9 between the points 10, 11, 12 and 13. One end of the body has a curved rod end 14 forming an open neck portion 15 with an opening 16 extending therethrough. The open neck portion 15 forms a continuous holding or strap receiving portion 17. This portion 17 could be held by a hook in a floorboard, as shown in U.S. Pat. No. 3,510,132, or by a pole placed therethrough on which a user could stand.

Shoulder rod portions 23 and 24 connect the two spaced elongated rod sections 26 and 7 at points 11 and 13, respectively, to ends 29 and 30, respectively, of neck portion 15. These shoulder rod portions 23 and 24 are shown transverse to the center line axis 28 of the two spaced elongated rod sections 26 and 7. The body A is curved at points 25 and 27, respectively, where the shoulder rod portions 23 and 24 connect at points 11 and 13. The body A is also curved at points 20 and 21, respectively, where the shoulder rod portions 23 and 24 connect to ends 29 and 30, respectively, of neck portion 15.

Rope guides 18 and 19 are provided by each inner radius where the body A is curved at points 20 and 21, respectively. These guides 18 and 19 provide a stationary bearing for the rope intermediate section 6 to slide between spaced rod sections 26 and 7, as will be hereinafter described. Shoulder rod portions 23 and 24 are shown perpendicular to the center line 28 of the two spaced rod sections 26 and 7 to prevent the rope intermediate section 6 from slipping over the outside radius where the body A is curved at points 25 and 27. Such slipping would permit the rope to bind up and prevent the exercising device 1 from working properly. The shoulder rod portions 23 and 24 could be angled to form deeper guides 18 and 19, if desired, and a higher projecting curvature at points 25 and 27.

The two spaced rod sections 26 and 7 taper inwardly towards the center line axis 28 as they extend from points 11 and 13 to points 10 and 12, respectively. At points 10 and 12, they extend as parallel rod sections 31 and 32. Parallel rod sections 31 and 32 are connected by a bottom curved section 33. All rod portions and sections (7, 26, 23, 24, 14, 15, 31, 32 and 33) of body A lie in the same plane (see FIGS. 2 and 4).

The rope 3 spirals up rod section 26 and extends over the neck portion 15, where the intermediate section 6 rests on guides 18 and 19, the rope 3 then spirals down the other rod section 7. The rope then extends from the body A to its ends 4 and 5. It can be seen that when support means 2 is fixed in place, as a user pulls alternately on the ends 4 and 5 of the rope 3, the contact of the rope and the rod sections of the body A provides friction and a resistance to the user.

To vary the number of loops which the rope 3 makes around the rod sections 26 and 7 of body A, the ends 4 and 5 of the rope 3 can be passed through the opening within the body A. Passing the ends in one direction increases the number of loops, or passing the ends in the other direction decreases the number of loops. If it is desired to only change loops on one of the spaced rod sections 26 and 7, then only one end of the rope is passed through the body A.

The number of loops the rope 3 makes around the rod sections 26 and 7 of body A can also be varied by lifting the intermediate section 6 of the rope 3 over the neck portion 15. It can be seen that as the intermediate rope section 6, as viewed in FIG. 1, is placed over the neck portion 15 with the rope section 6 being readjusted over the rope guides 18 and 19, one loop is removed from each spaced rod section 26 and 7. It can also be seen that as the intermediate rope section 6, as viewed in FIG. 1, is pulled through the opening 16 of neck portion 15 and then pulled over neck portion 15 with the rope section 6 being readjusted over the rope guides 18 and 19, one loop is added to each spaced rod section 26 and 7.

To prevent the rope 3 from slipping up rod sections 26 and 7, especially during operation from a standing position, and to maintain them in the small end of the body A between parallel rod sections 31 and 32 and curved section 33, a rope guide 34 is snapped onto parallel rod sections 31 and 32 at points 35 and 37 perpendicular to center line axis 28. The rope guide 34 forms an opening 89 with the parallel rod sections 31 and 32 and curved section 33. The rope ends 4 and 5 will pass over the top of the rope guide 34 at points 37 and 38, respectively, as shown in FIG. 2 and will then pass back through the opening 89. The inward pressure of the rope 3 at the points 37 and 38 of the rope guide 34 during operation will prevent the rope guide 34 from popping off parallel rod sections 31 and 32 during operation. Snap sections 39 and 40 of rope guide 34 have a slightly smaller inside diameter than the outside diameter of parallel rod sections 31 and 32 of exercising device 1. This enables the rope guide 34 to remain in position during non-operational periods and also provides for easy removal when the tension is being adjusted by the use of the ends of the ropes 4 and 5, and especially when handles 44 and 43 are being used.

The handles 43 and 44, referred to above, have a contoured holding shape 47 extending between end surfaces 48 and 49. The handles have a longitudinal or axial bore 55 formed therein through which the rope ends 4 and 5 of the rope 3 extend. The diameter of the axial bore 55 is slightly larger than the diameter of the rope 3, thus allowing the handles 43 and 44 to slide axially along the rope 3 and to rotate therearound. For operation, one end of the rope has a knot 56 placed in the end thereof (rope end 5 as shown in FIG. 1), while the length of the rope 3 is adjusted to the desired exercise length by slipping the handle 43 or 44 on the other end of the rope to the desired exercise length and then tying a slip knot 46 into the rope (rope end 4 as shown in FIG. 1). The rope end knot 56 and the slip knot 46 is pulled into a countersunk portion into the end 49 of its respective handle 43 or 44.

Thus the slip knot 46 limits the length of the exercise rope 3. This knot 46 can be pulled apart quite easily by grasping the rope 3 at positions 51 and 52 and pulling outward axially until the slip knot comes apart. The rope 3 is then ready for adjustment to the next exercise. While rope knots have been used to secure the handles 43 and 44 on rope 3, other known holding means can be used, such as a small clamping device (not shown).

To use the exercising device 1 for a leg exercise, circular straps can be placed at a proper position, one on rope end 5 and one on rope end 4, with the slideable handles 43 and 44 remaining on the rope 3. With the body A fixed in position, a user located beneath the exerciser device 1 can have his feet positioned one in each footstrap to alternately move the rope ends and pull the rope 3 over the body A, while the user's hands can grasp the handles 43 and 44 above him, permitting the rope to be guided therethrough and permitting the user to vary the distance between the handles to also vary the exercise performed by the user.

The solid continuous piece of contoured rod of the body can be made of any one of many well known materials which will properly hold its contour during use. One body was made from cold rolled steel and chrome plated.

I claim:

1. An exercising device for use with a length of rope comprising a body formed by only a single continuous contoured rod, said body having two spaced apart rod sections, each spaced apart rod section being long enough to have several turns of rope therearound, one end of each of the rod sections bending inwardly toward the other rod section, each of said inwardly extending rod sections forming a shoulder, said inwardly extending rod sections bending to extend as substantially parallel rod sections to a point where they bend toward each other and join to form a curved end, said parallel rod sections forming an open neck portion, the two spaced apart rod sections extend from said shoulders and are attached to form a second curved end, said two spaced apart rod sections taper towards each other as they extend from said shoulders, the bend between each inwardly extending rod section forming a shoulder and each parallel rod section forming the neck portion provides for a rope guide and bearing for guiding a length of rope from one spaced apart rod section to the other.

2. An exercising device as set forth in claim 1 wherein said two spaced apart rod sections are attached to the second curved end by a second pair of short parallel rod sections.

3. An exercising device as set forth in claim 2 wherein a removable rope guide is fixed across the second pair of short parallel rod sections and forms an opening with the second pair of parallel rod sections and the second curved end, said opening being provided to receive rope ends therethrough to maintain them in that portion of the body.

4. A method of forming an exercising device body having a center line by only a single continuous rod, (1) forming said single continuous rod to have two spaced apart sections (26 and 7) on each side of a center line (28) with a curved end (33) connecting them;

(2) forming said spaced apart sections (26 and 7) to have them extend outwardly at an angle to each other from said curved end (33);

(3) forming said spaced apart sections (26 and 7) to have them extend towards each other, at a location from said curved end (33) which will permit several turns of rope therearound, to form shoulder portions (23 and 24);

(4) forming each shoulder portion (23 and 24) to extend substantially parallel to each other as a neck portion (15);

(5) forming the ends of the substantially parallel neck portion (15) to curve towards each other and meet to form another curved end (14).

* * * * *